US006807832B1

(12) United States Patent
Jeng

(10) Patent No.: US 6,807,832 B1
(45) Date of Patent: Oct. 26, 2004

(54) AUXILIARY UNIT OF A SUITCASE LOCK

(76) Inventor: Yung-Yuan Jeng, No. 15, Lane 212, Sec. 1, Dongmen Rd., Tainan (TW)

( * ) Notice: Subject to any disclaimer, the term of this patent is extended or adjusted under 35 U.S.C. 154(b) by 0 days.

(21) Appl. No.: 10/731,127

(22) Filed: Dec. 10, 2003

(51) Int. Cl.[7] ..... E05B 65/52

(52) U.S. Cl. ..... 70/68; 70/69; 190/101; 190/903

(58) Field of Search ..... 70/18, 30, 49, 70/58, 59, 68, 69, 76; 150/102; 190/101, 903, 118–122

(56) References Cited

U.S. PATENT DOCUMENTS

| | | | | | |
|---|---|---|---|---|---|
| 4,066,195 | A | * | 1/1978 | Dickler | 224/153 |
| 4,685,315 | A | * | 8/1987 | Comolli | 70/68 |
| 4,738,341 | A | * | 4/1988 | Asano | 190/101 |
| 4,756,171 | A | * | 7/1988 | Homar | 70/18 |
| 4,792,026 | A | * | 12/1988 | Dimmick et al. | 190/101 |
| 5,689,979 | A | * | 11/1997 | Yu | 70/69 |
| 6,016,675 | A | * | 1/2000 | Te | 70/312 |
| 6,202,455 | B1 | * | 3/2001 | Su | 70/68 |
| 6,463,771 | B1 | * | 10/2002 | Judge | 70/68 |
| 6,568,225 | B1 | * | 5/2003 | Chang | 70/69 |
| 6,604,390 | B1 | * | 8/2003 | Nooner | 70/63 |
| 6,684,667 | B2 | * | 2/2004 | Young | 70/18 |
| 2002/0129628 | A1 | * | 9/2002 | Skalberg | 70/18 |

FOREIGN PATENT DOCUMENTS

| | | | | |
|---|---|---|---|---|
| FR | 1032266 | * | 6/1953 | 70/69 |
| IT | 456632 | * | 11/1948 | 70/69 |

* cited by examiner

*Primary Examiner*—Lloyd A. Gall
(74) *Attorney, Agent, or Firm*—Rosenberg, Klein & Lee

(57) ABSTRACT

A suitcase lock includes a primary unit fitted on a suitcase, a wire housing fitted on a suitcase, a reel and elastic element combination arranged in the housing, and a wire; the wire is connected with the reel at an inner end, and a locking tab at an outer end, which is pass through the housing; the primary unit has several lock holes, and can secure a pair of zipper slides of the suitcase after the slides are inserted in the lock holes; the locking tab is shaped in such a way that it can be secured in position by the primary unit when it is inserted in one of the lock holes; the reel is biased towards a storing position by the elastic element, in which storing position the wire is substantially completely wound around the reel.

3 Claims, 7 Drawing Sheets

AUXILIARY UNIT OF A SUITCASE LOCK

BACKGROUND OF THE INVENTION

1. Field of the Invention

The present invention relates to an auxiliary unit of a suitcase lock, more particularly one, which can secure a suitcase to other objects for preventing the whole suitcase from being stolen besides making the suitcase lock in the closed position, and which is convenient to use.

2. Brief Description of the Prior Art

People usually carry suitcases in traveling. Most suitcases are equipped with locks for preventing thieves from opening the suitcases to steal easily. A kind of conventional suitcase lock unit is secured to a suitcase, and has several lock holes, which lock can secure a pair of slides of a zipper of the suitcase in position after the suitcase is closed with the zipper, and the slides inserted in the lock holes. The slides will be released from the lock holes after the lock unlocks.

However, even if a suitcase is locked in the closed position, thieves still can take the whole suitcase away while the owner of the suitcase is not paying attention.

Therefore, an auxiliary unit is provided to the above suitcase lock, which includes a cover, a wire joined to the cover at one end, and a locking tab joined to the other end of the wire. The cover has a through hole while the locking tab can be secured to the lock after it is inserted in one of the lock holes. To use the auxiliary unit, the cover is positioned over the lock with the through hole opposing the lock holes of the lock, and then the wire is passed around other fixed objects. And finally, the locking tab is locked in one of the lock holes. Thus, the suitcase can't be taken away unless the lock unlocks.

However, because the auxiliary unit is not fitted on the suitcase, the user will be worried about storage of the auxiliary unit while the unit is not being used. Furthermore, the user has to handle the wire after the suitcase is unlocked otherwise the wire might cause inconvenience.

SUMMARY OF THE INVENTION

It is a main object of the present invention to provide a suitcase lock to overcome the above disadvantage.

The suitcase lock includes a primary unit fitted on a suitcase, and an auxiliary unit, which includes a wire storage housing fitted on the suitcase, a reel and elastic element combination arranged in the housing, and a wire. The wire is connected with the reel at an inner end, and a locking tab at an outer end, which is pass through the housing. The primary unit has several lock holes, and can secure a pair of zipper slides of the suitcase in position after the slides are inserted in the lock holes. The locking tab is shaped in such a way that it can be secured in position by the primary unit when it is inserted in one of the lock holes. The reel is biased towards a storing position by the elastic element, in which storing position the wire is substantially completely wound around the reel.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
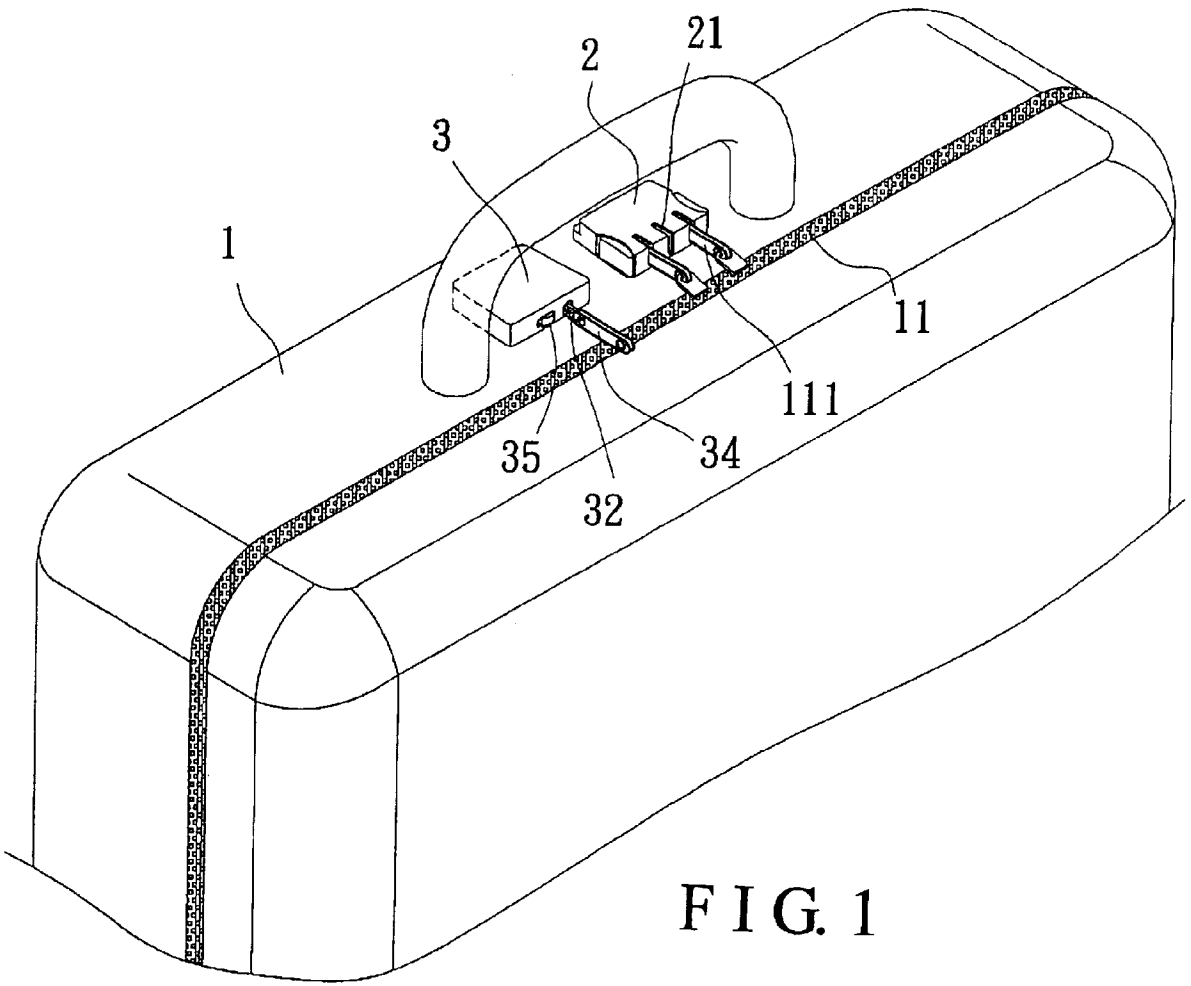
FIG. 1 is a perspective view of the auxiliary lock unit of the present invention, fitted to a suitcase.
Figure 5:
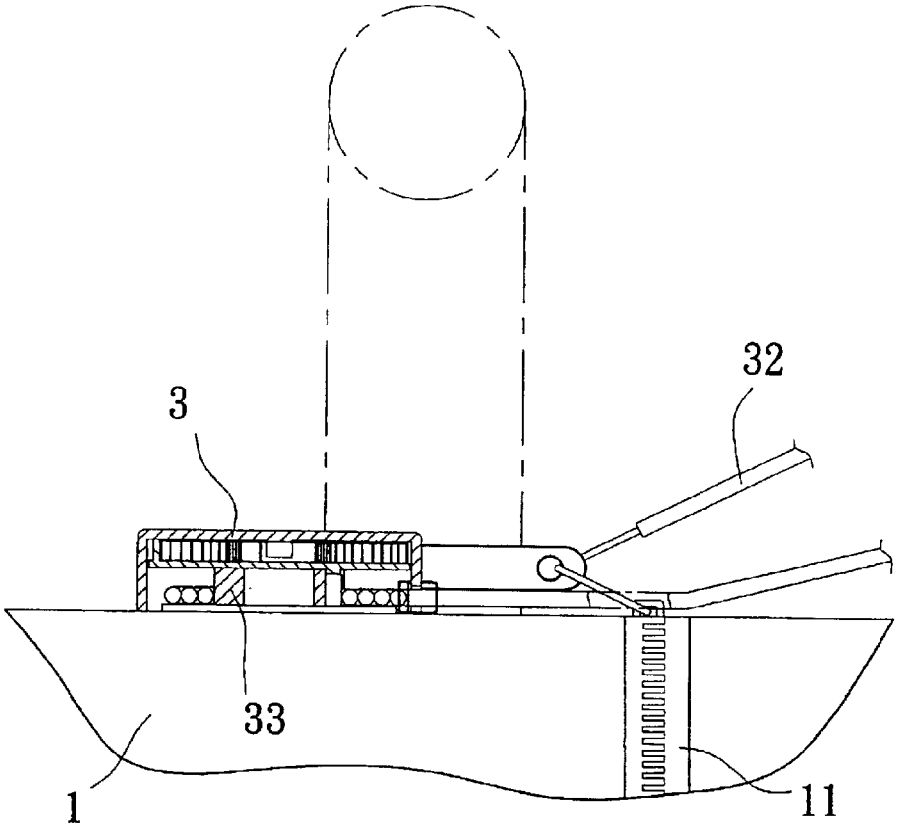
FIG. 5 is a side view of the auxiliary lock unit of the present invention, fitted to a suitcase.
Figure 2:
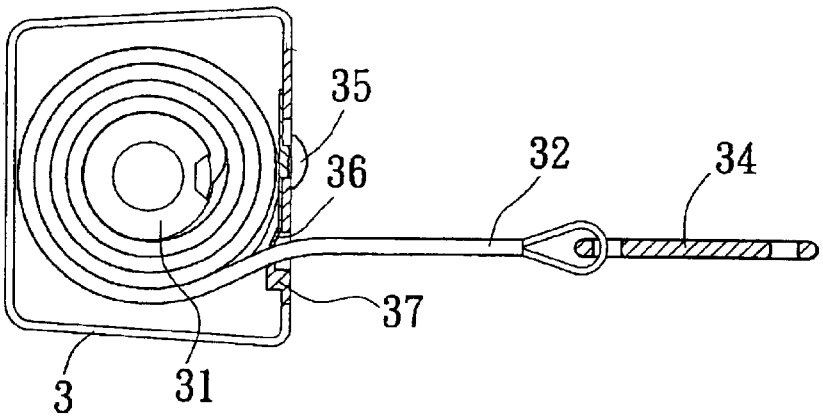
FIG. 2 is a horizontal section of the auxiliary lock unit of a suitcase according to the present invention.
Figure 3:
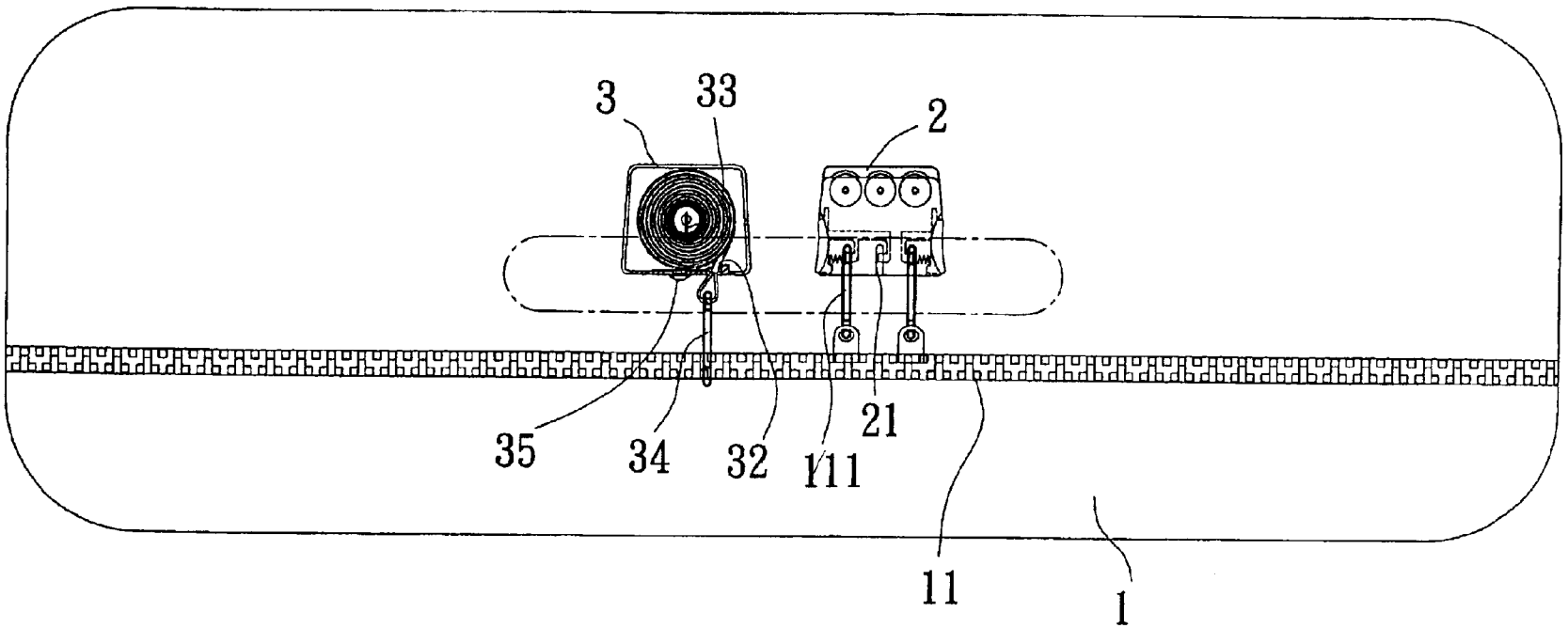
FIG. 3 is a horizontal section of the auxiliary lock unit of the present invention and a conventional lock, fitted to a suitcase.
Figure 4:
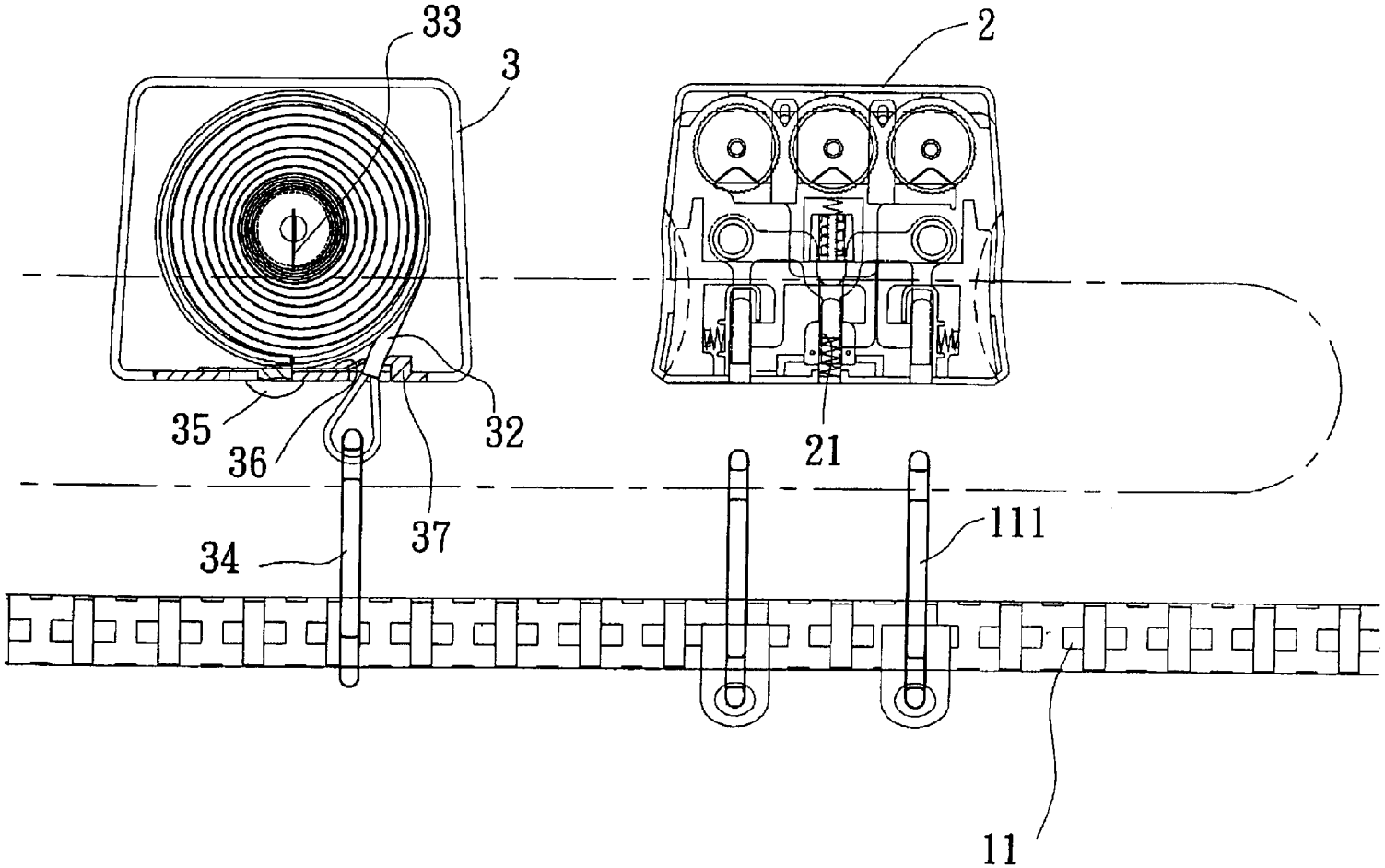
FIG. 4 is an enlarged horizontal section of the auxiliary lock unit of the present invention and the primary lock unit, fitted to a suitcase.
Figure 6:
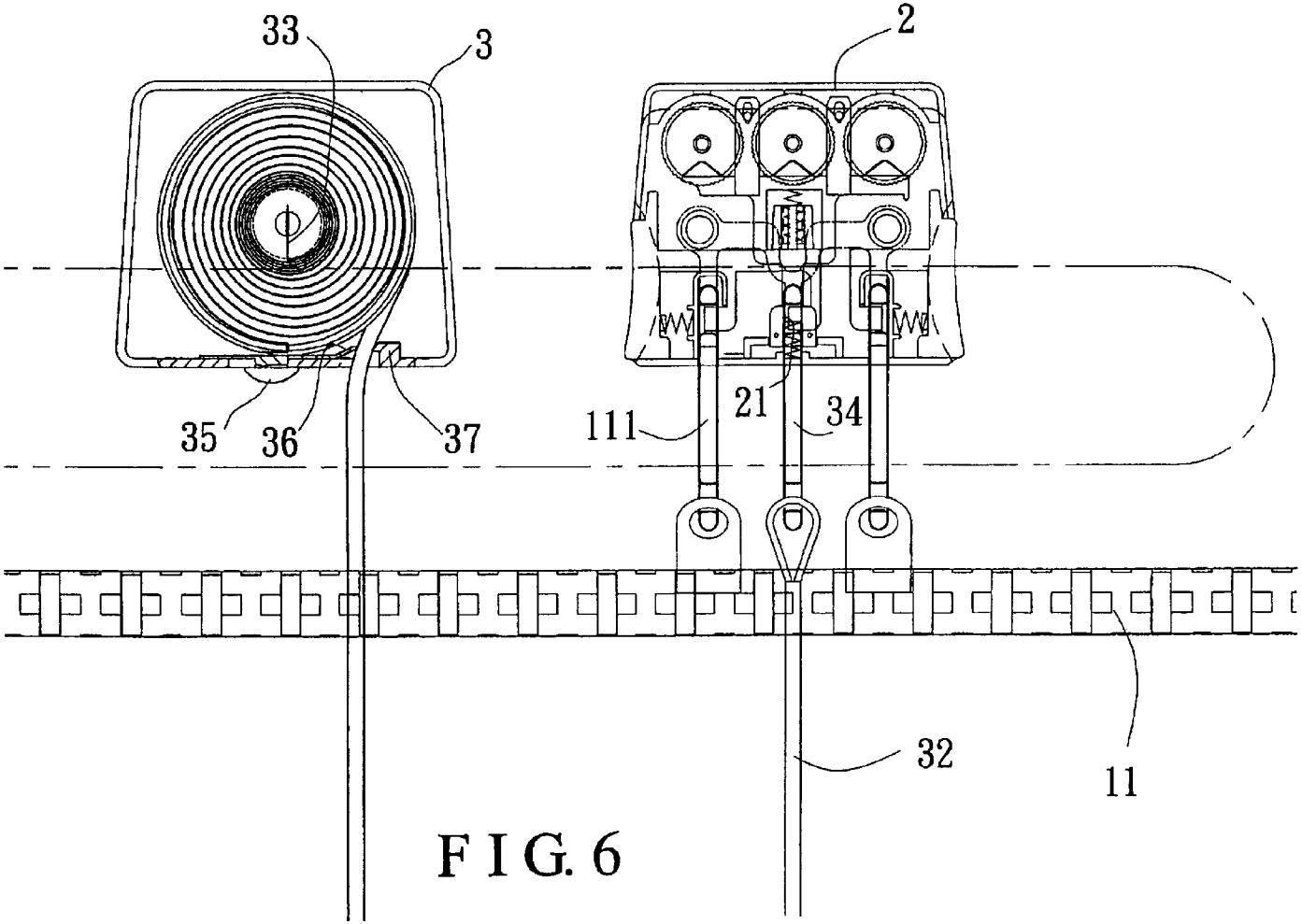
FIG. 6 is a horizontal section of the auxiliary lock of the present invention and the primary lock unit, in the locking position.

Referring to FIG. 1, a preferred embodiment of an auxiliary unit of a suitcase lock in the present invention is provided, which has to be used together with a primary lock unit 2 of a suitcase 1. The suitcase 1 has two main holding parts, and a zipper 11, which is equipped with two slides 111, usable for connecting both the suitcase holding parts.

The primary lock unit 2 is secured in position near to a handle of the suitcase 1, and has three lock holes 21 thereon. The primary lock unit 2 can secure the slides 111 of the zipper 11 in position to prevent the suitcase 1 from being opened without the key after the slides 111 have been inserted in the lock holes 21 thereof, as shown in FIG. 1. The structure of the primary lock unit 2 isn't the subject of the present invention therefore it won't be detailed herein.

The auxiliary unit includes a wire storage housing 3, a reel 31, a wire 32, an elastic element 33, and a male locking tab 34. The wire storage housing 3 is secured to the suitcase 1 near to the primary lock unit 2, and has an opening (not numbered) thereon. The wire 32 is connected with the male locking tab 34 at a first end, and the reel 31 at a second end thereof; the locking tab 34 is shaped in such a way that it will be secured in position by the primary lock 2 when it is inserted in one of the lock holes 21. The reel 31 and the elastic element 33 are connected with each other, and disposed in the wire storage housing 3 with the first end of the wire 32 passing through the opening of the wire storage housing 3 such that the reel 31 is biased towards a storing position by the elastic element 33, in which storing position the wire 32 is substantially completely wound around the reel 31 except for the first end thereof.

In addition, a stopping block 37 is securely disposed next to one side of the opening of the wire storage housing 3, a control block 35 is movably fitted on the housing 3, and a pressing plate 36 is connected to the control block 35 so as to be next to the other side of the opening of the housing 3. Thus, one can move the control block 35 to a securing position to make the wire 32 firmly and tightly held between the pressing plate 36 and the stopping block 37, thus preventing the wire 32 from being wound back around the reel 31 after the wire 32 is stretched for use.

To use the present suitcase lock, the wire 32 is stretched, and passed around or over other fixed objects, and then the male locking tab 34 is inserted in one of the lock holes 21 of the primary lock unit 2, thus, one can't take the whole suitcase 1 away in case he doesn't have the key for the primary lock unit 2; by means of moving the control block 35 to the securing position, the user can prevent the wire 32 from being pulled back into the housing 3 by the reel 31 after stretching the wire 32 for use.

Figure 7:
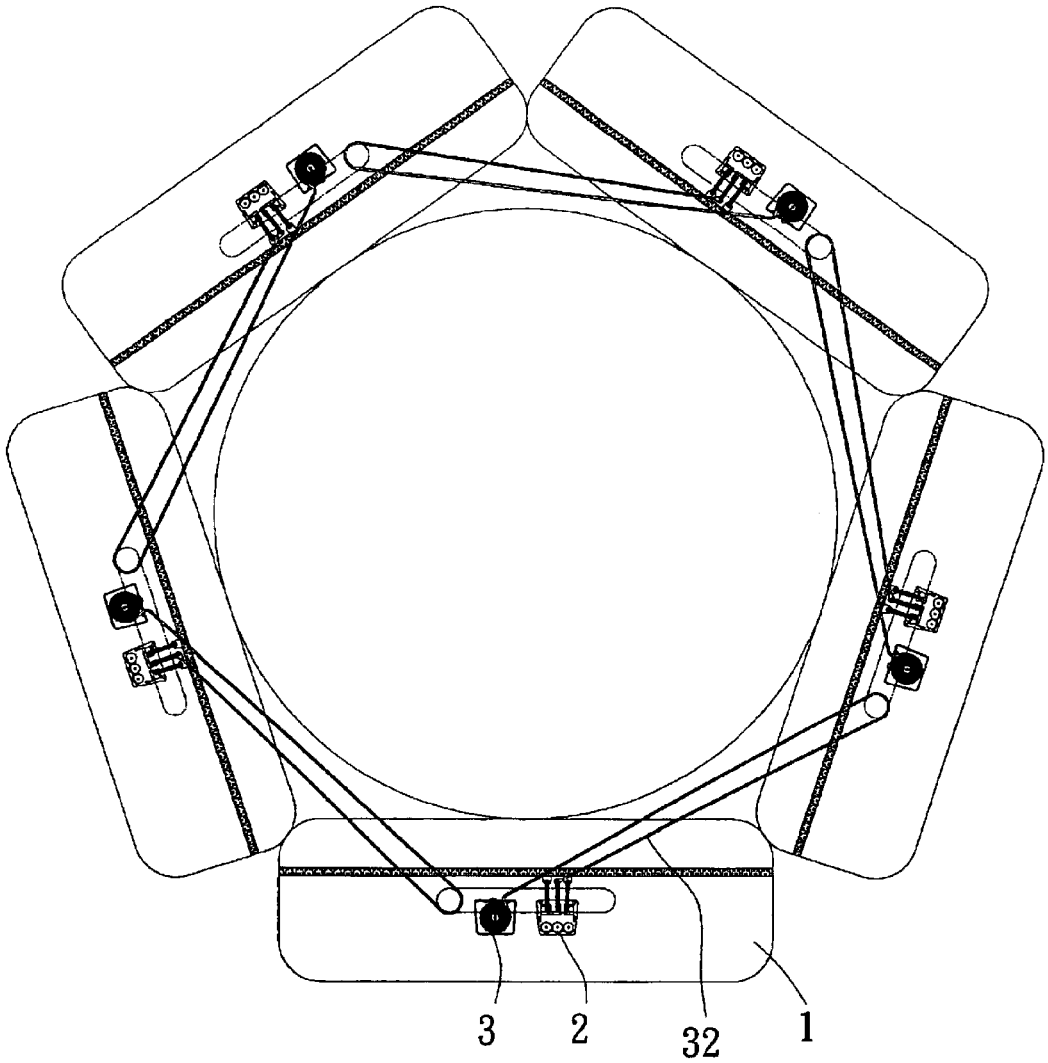
FIG. 7 is a view illustrating the use of the auxiliary lock unit of a suitcase according to the present invention.

In case one has several suitcases of the same kind, he/she can arrange the suitcases one next to another, and tie the suitcases together by means of the wires 32 of the auxiliary units as well as the primary lock units 2, as shown in FIG. 7; thus, it will be difficult for thieves to take the suitcases away.

Figure 8:
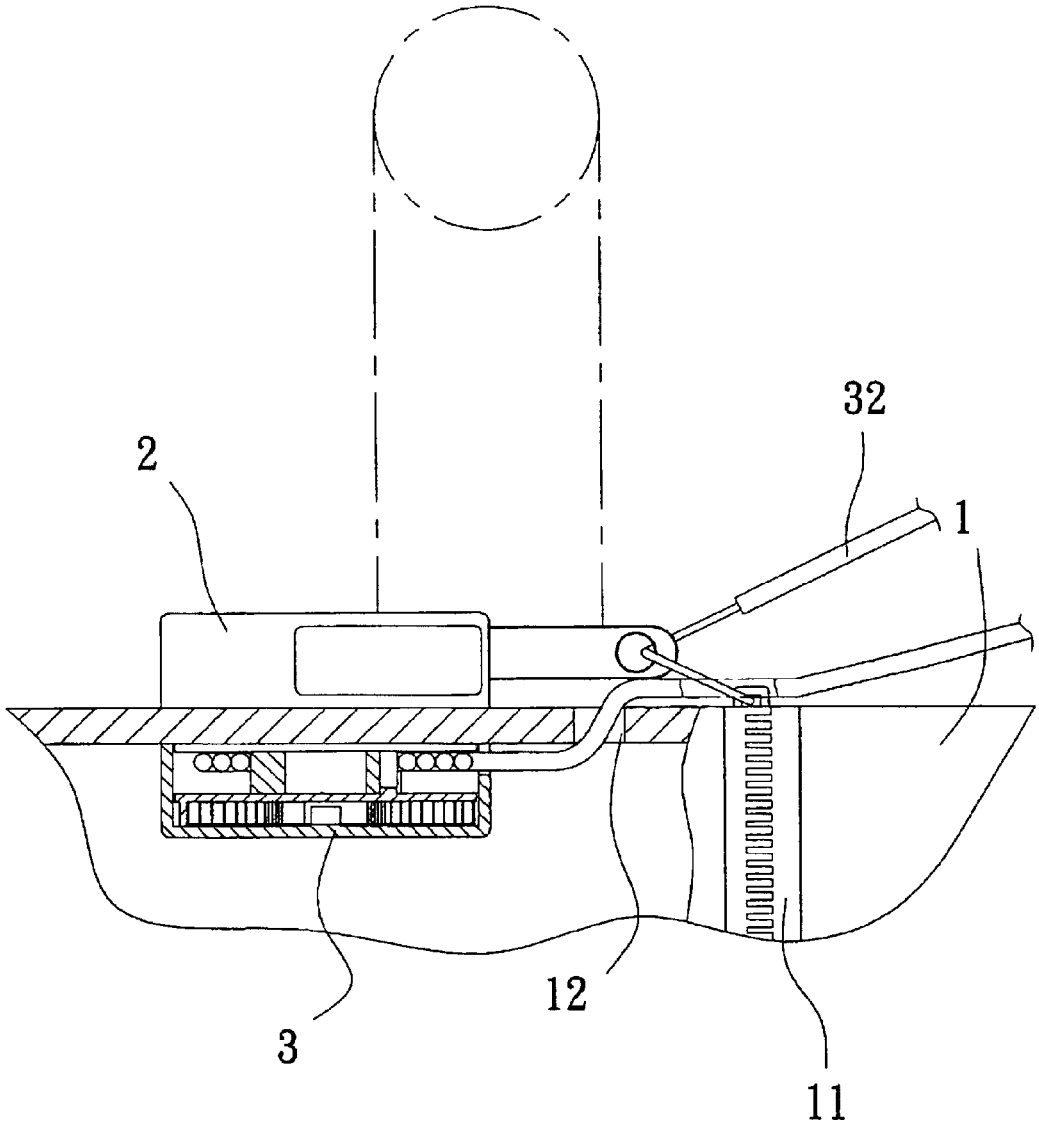
FIG. 8 is a vertical section of a second embodiment of an auxiliary lock unit of a suitcase in the present invention.

Referring to FIG. 8, according to a second embodiment of the present invention, wire storage housing 3 is secured to an inner side of the suitcase 1 instead, and wire 32 is passed through a through hole of the suitcase 1.

From the above description, it can be understood that the auxiliary unit of a suitcase lock of the present invention has advantages as followings:

1. The wire can be automatically wound back around the reel, and the user doesn't have to spend time in handling or storing the wire after the tab 34 is released to unlock the suitcase. Therefore, the auxiliary unit is convenient to use.
2. The auxiliary unit is attached to the suitcase, and can't get lost while it is not being used. Therefore, the user doesn't have to worry about storage of the auxiliary unit.

What is claimed is:

1. An improvement on a suitcase lock, comprising a primary lock unit fitted on a suitcase; the primary lock unit having a plurality of lock holes for securing a pair of zipper slides of the suitcase in position after the slides are inserted in the holes; and an auxiliary unit; the auxiliary unit including:

(1) a wire storage housing securely fitted to the suitcase; the housing having an opening;

(2) a reel and elastic element combination arranged in the wire storage housing; and (3) a wire connected with a male locking tab at a first end, and the reel at a second end; the wire being passed through the opening of the wire storage housing at the first end thereof;

the reel being biased towards a storing position by the elastic element, in which storing position the wire is substantially completely wound around the reel except for the first end thereof;

the male locking tab being shaped in such a way as to be capable of being secured in position by the primary lock unit when it is inserted in one of the lock holes.

2. The suitcase lock as claimed in claim 1, wherein the wire storage housing is secured to an inner side of the suitcase, and the first end of the wire is passed through a though hole of the suitcase.

3. The suitcase lock as claimed in claim 1, wherein a stopping block is secured to the wire storage housing, and a control block is movably fitted on the storage housing with a pressing plate joined thereto; the wire being capable of being firmly and tightly held between the pressing plate and the stopping block to be unmovable by the reel when the control block is moved to a securing position.

* * * * *